United States Patent [19]

Strobel

[11] 4,122,916

[45] Oct. 31, 1978

[54] SCAFFOLDING

[76] Inventor: William C. Strobel, W. 4615 Wellesley, Spokane, Wash. 99205

[21] Appl. No.: 803,787

[22] Filed: Jun. 6, 1977

[51] Int. Cl.[2] ..... E04G 3/08

[52] U.S. Cl. ..... 182/82; 182/45; 248/240.2

[58] Field of Search ..... 182/82, 113, 45; 248/235, 240, 240.2, 240.4

[56] References Cited

U.S. PATENT DOCUMENTS

| | | | |
|---|---|---|---|
| 2,988,181 | 6/1961 | Darrey | 182/82 |
| 3,595,510 | 7/1971 | Hutchinson | 182/82 |

FOREIGN PATENT DOCUMENTS

| | | | |
|---|---|---|---|
| 167,012 | 10/1950 | Austria | 182/82 |
| 2,307,937 | 12/1976 | France | 182/82 |

*Primary Examiner*—Reinaldo P. Machado
*Attorney, Agent, or Firm*—Wells, St. John & Roberts

[57] ABSTRACT

A scaffold structure for attachment to wall surfaces. Telescoping horizontal members are supported at an inner end by a secured wall bracket. The horizontal members are usable to carry a work platform resting on their upper surfaces. They are supported intermediate their ends by a depending bracket mounted to either a vertical post resting on a ground surface or an angular support extending upward from a lower wall bracket. Their outer ends include vertically open brackets for mounting vertical boards to serve as ground supports and/or handrail supports. A protective handrail can be mounted to the vertical boards at the outer ends of the horizontal members. An upright fixed adjacent to the outer end of each horizontal member is intersected by a roof member to provide an alternate form of outer support.

8 Claims, 10 Drawing Figures

31
30
16
13
19
19
18
14
25
28
17
10
22
22
29
11

41
13
14
10
41
18
14
28
16
13
40
13
14

SCAFFOLDING

BACKGROUND OF THE INVENTION

This invention arose from an effort to design a relatively simple scaffold structure usable particulary at the exterior of a building during construction or repair, the scaffold being versatile, relatively inexpensive, and readily movable about a job site or from one job site to another. The scaffold structure was designed for ready adjustment to the particular size restrictions imposed by a job site.

A prior telescoping scaffold structure is shown in U.S. Pat. No. 3,595,510, where the scaffold is entirely wall-supported. This patent discloses tubular members for mounting guard rails at the outer ends of the cantilevered scaffold structure.

U.S. Pat. No. 2,988,181 discloses a scaffolding element supported by a ground engaging pipe that extends through an end bracket. U.S. Pat. No. 3,698,680 discloses a scaffold bar having an outer socket for receiving a rail post. U.S. Pat. No. 1,722,018 discloses a scaffold structure fixed to the side of a wall and including corner brackets for wrapping the scaffold around an exterior corner. U.S. Pat. Nos. 3,472,338 and 3,552,522 each disclose scaffold structures having a supporting element fixed to a roof surface. While some of these elements are generally common to the present disclosure, one result of the present invention is to unitize these and other features of the scaffold structure into a highly versatile arrangement capable of meeting almost any requirement for support of a work platform alongside a vertical wall surface.

The invention basically comprises telescoping first and second horizontal members adapted to support a horizontal work platform resting on their upper surfaces. The two membrs can be extended any desired distance outward from a supporting upright wall element. A bracket fixed to the inner end of the first horizontal member secures it to the upright wall element at an above-ground elevation. The inner end of the second horizontal member mounts a depending bracket. This bracket in turn is attached to an upright support extending downward from the bracket to a fixed reference, which is normally a floor or ground surface beneath the scaffold structure or a lower wall bracket.

DESCRIPTION OF THE PREFERRED EMBODIMENTS

The scaffolding described in detail below has been developed specifically for construction and repair along upright walls, particularly exterior walls. However, it is readily usable along interior walls where needed. It is adaptable to single wall construction, double wall construction and upright forms. The application of the scaffolding will be evident from a discussion of its structural details, but it is to be emphasized that such application is not to limited to any particular types of wall construction. Furthermore, while reference will be made to exterior applications and to use of the scaffolding at locations elevationally "above-ground," the term "ground" is used herein as being equivalent to floors and other horizontal support members located beneath the scaffold platform.

As used herein, the relative locations of the various elements in the scaffolding will be described with repect to their positions or directions in relation to the work platform itself. The work platform (designated by the dashed line showing at 15 in FIG. 1) is viewed in a horizontal orientation at the vertical center of FIG. 1. A typical wall element 10 in the form of a vertical stud and overlying panel is shown at the left in FIG. 1. The scaffolding protrudes to the right of the wall element 10, which shall be referred to herein as being "outward" from the wall element 10. Directions and elements located or facing toward the wall element 10 shall be indicated by the terms "inner" or "inward." Those elements extending beneath the platform 15 shall be referred to as depending "downwardly," and those protruding above the platform 15 shall be referred to as extending "upwardly."

Figure 1:
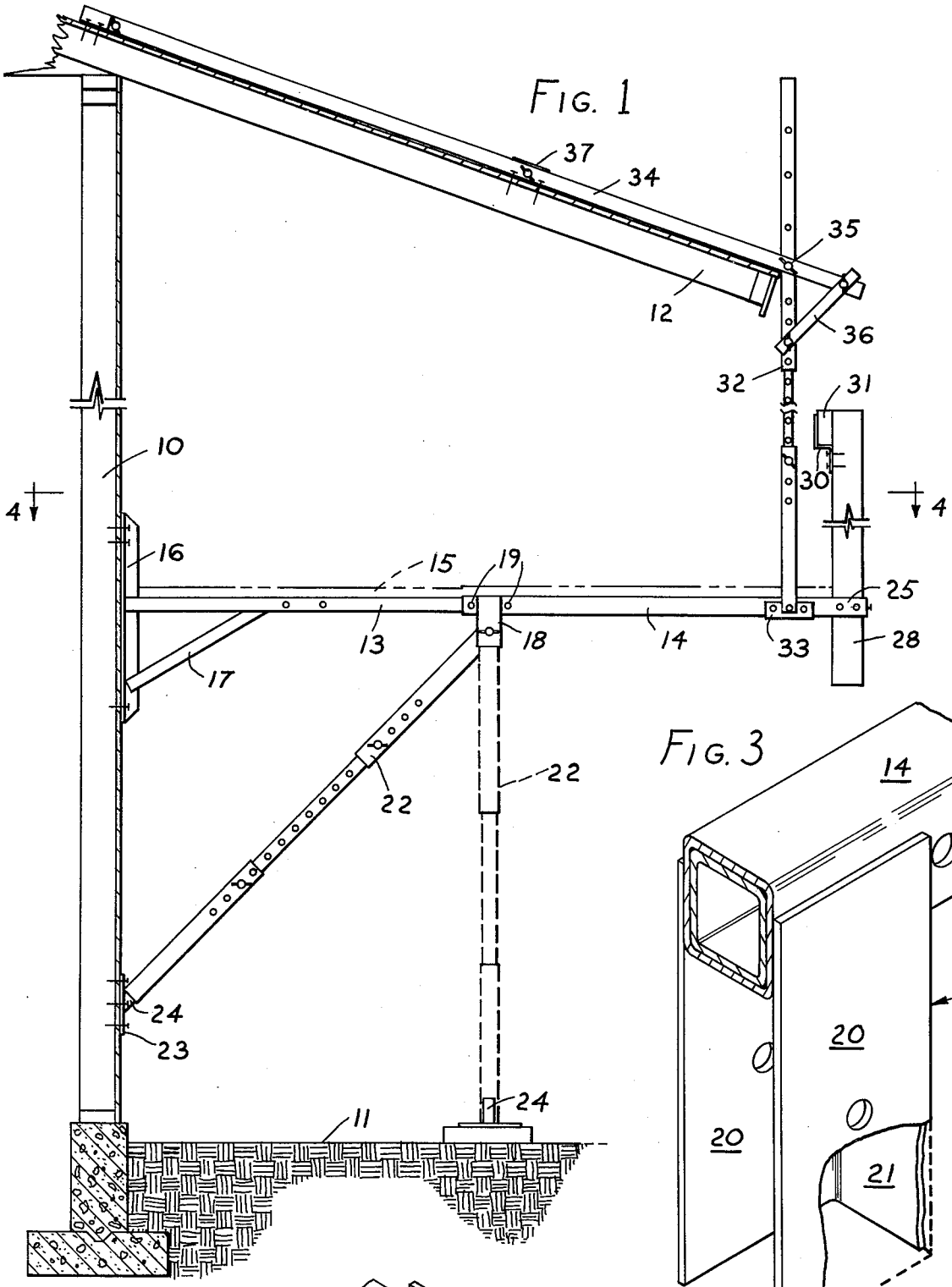
FIG. 1 is a side elevation view of the scaffold structure, a portion of the wall and upright support above the horizontal members being broken away.

Besides wall element 10, the environment in which the scaffolding is used is illustrated in FIG. 1 as including a roof overhang 12 comprised of the usual rafter and deck structure. A horizontal ground surface 11 extends from the wall element 10 beneath the scaffolding area.

The scaffold structure includes first and second horizontal members 13 and 14. The first horizontal memer 13 has opposed inner and outer ends, its inner end being fixed to a vertical wall bracket 16. A lower brace 17 completes a triangular configuration extending from the first member 13 downwardly and inwardly to a fixed connection at the wall racket 16, this connection being located beneath the inner end of horizontal member 13.

The inner end of the second horizontal member 14 is telescopically connected to the outer end of the first horizontal member 13. This telescopic connection is longitudinally adjustable and can be fixed by conventional bolts and wing nuts or other suitable fasteners. The two members 13, 14 are therefore mounted for coaxial positional adjustment relative to the upright wall element to permit variation in their outward extension from the wall element 10. The connecting bolt assemblies 19 (FIG. 1) fix the member 14 to the member 13 at their desired extension.

Figure 3:
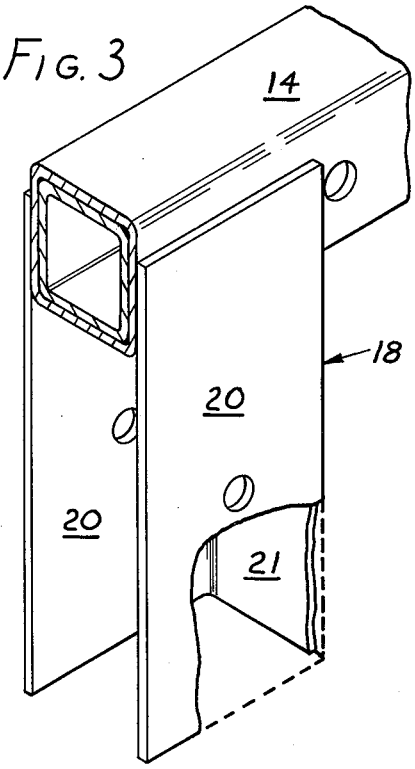
FIG. 3 is a fragmentary perspective view of a depending bracket on a horizontal member.

A depending bracket 18 (FIG. 3) is fixed to the inner end of the member 14 to provide vertical support intermediate the combined length of members 13 and 14. The bracket 18 has parallel side walls 20 connected by an outer upright wall 21. Bracket 18 is therefore open downwardly as well as vertically along a direction facing the supporting member 13 and wall element 10.

This provides a bracket configuration capable of alternatively being connected to a vertical post or to an inwardly inclined support. The two alternatives are illustrated in solid lines and dashed lines in FIGS. 1 and 5 respectively.

Referring specifically to FIG. 1, the inclined support 22 is illustrated as being comprised of three telescoping tubular members having longitudinally spaced apertures for receiving connecting bolts and wing nuts to secure them at the proper length for support of bracket 18 from the wall or ground elevation. The lower end of support 22 receives a post 24 on either a ground bracket or a wall bracket indicated specifically at 23. The wall bracket includes a flange which can be nailed or otherwise secured to the wall element 10.

Figure 5:
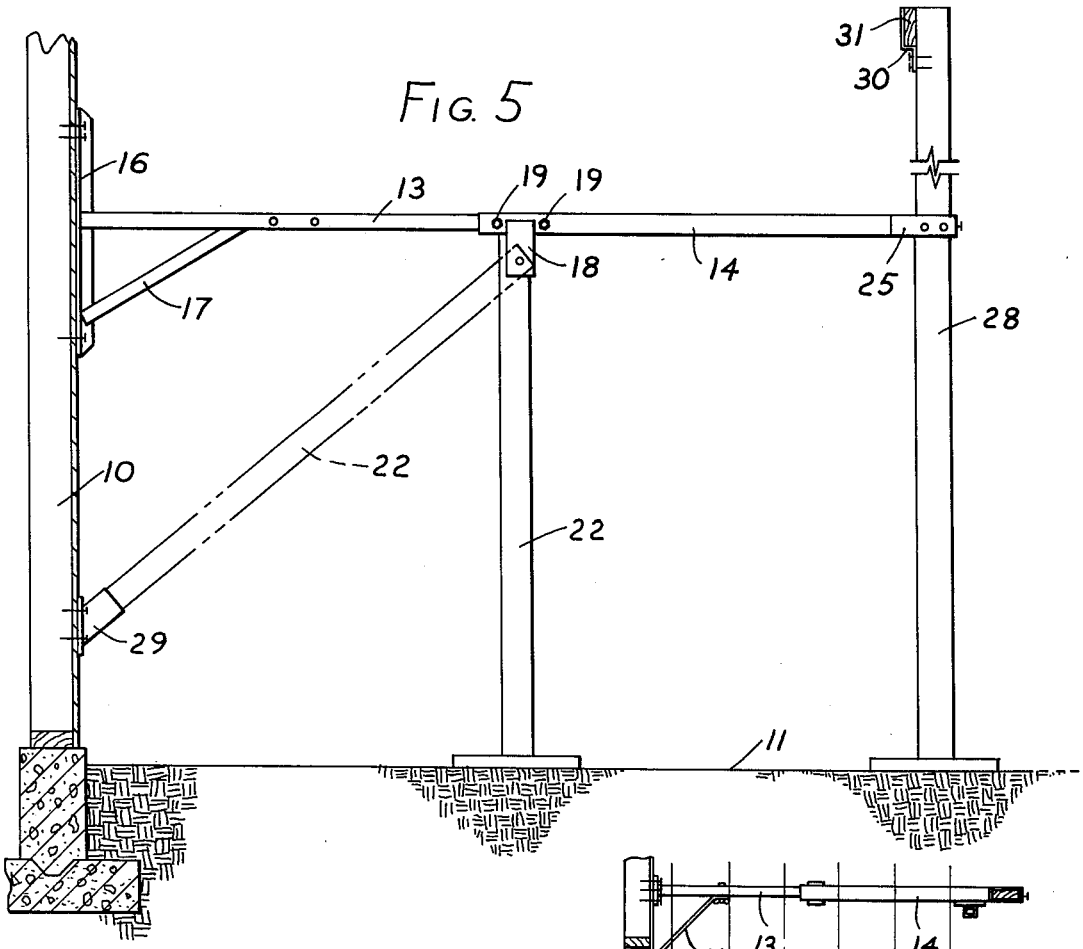
FIG. 5 is a view similar to FIG. 1, showing a modified embodiment.
Figure 9:
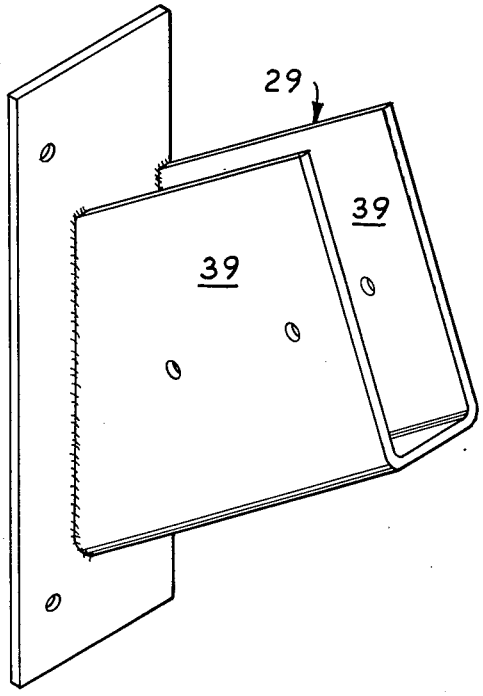
FIG. 9 is a perspective view of a lower wall bracket.

As indicated in FIG. 5, the depending bracket 18 can be dimensioned to permit the use of conventional boards as the support 22. For this purpose, the spacing between the side walls 20 of bracket 18 must be complementary in transverse width to the size of normal dimension lumber. A board of such dimension lumber having a suitable length to extend between bracket 18 and the ground surface 11 or wall element 10 is then fixed to the bracket 18 and to an upwardly open wall bracket 29, also having side walls 39 spaced a distance complementary to the size of the dimension lumber. The bracket 29 is illustrated in detail in FIG. 9 of the drawings.

Figure 6:
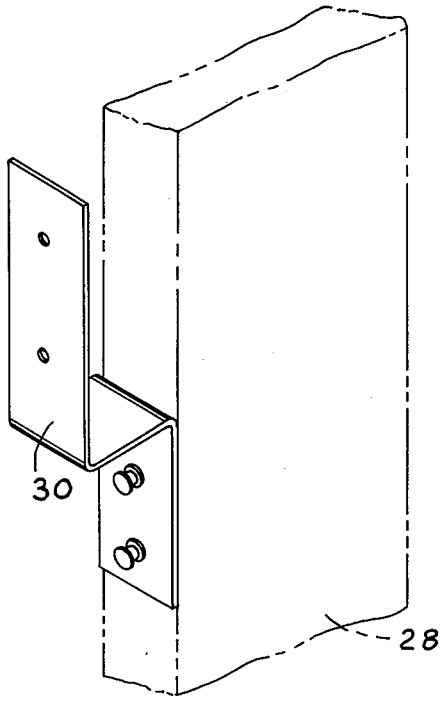
FIG. 6 is a fragmentary perspective view of a rail bracket.
Figure 7:
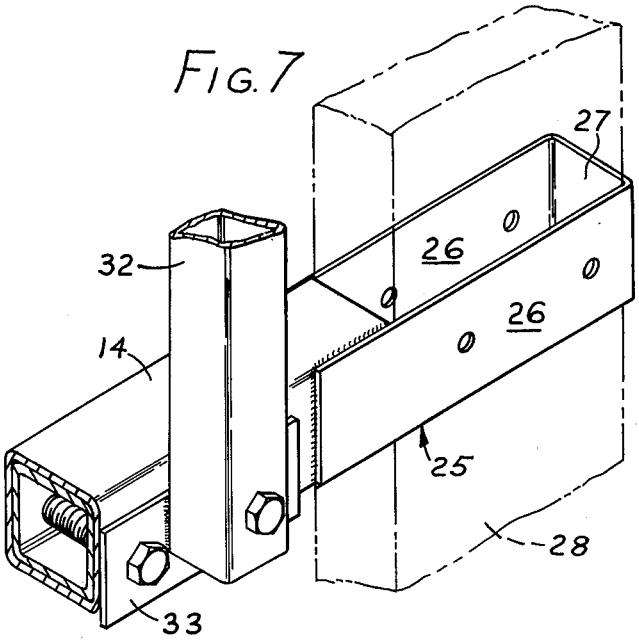
FIG. 7 is a fragmentary perspective view of the outer end of a horizontal member.

The outer end of each member 14 supports a fixed end bracket 25 (FIG. 7). The bracket 25 comprises parallel sides 26 and an enclosing end plate 27. The cross-sectional configuration within the end bracket 25 is complementary to the width and thickness of a selected size of dimension lumber. By this means, a vertical board 28 can be nailed or otherwise secured within end bracket 25. The board 28 can extend above and/or below bracket 25 to serve as a rail support, a ground support, or both. A board serving only as a rail support is illustrated in FIG. 1, while a similar board is illustrated in FIG. 5 extending continuously from the ground, through bracket 25, to an elevated rail 31. The horizontal rail 31, typically of selected dimension lumber, is held in bent rail brackets 30 shown in detail in FIG. 6. Brackets 30 are nailed or otherwise secured to both the vertical board 28 and the horizontal rail 31.

When the scaffold structure is being used beneath a roof overhang 12, its outer end can then be supported from the roof in the manner shown in FIG. 1. In these situations, a telescoping, vertically adjustable upright 32 is bolted or otherwise fixed to the member 14 at a location adjacent to its outer end. A connecting flange 33 (FIG. 7) is used to secure the lower end of upright 32 to member 14. Upright 32 extends upwardly from member 14 to an elevation above the roof.

Figure 2:
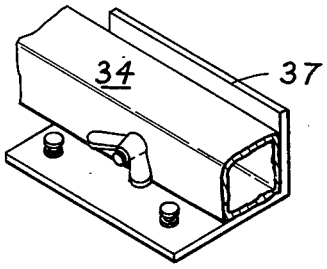
FIG. 2 is a fragmentary perspective view of a roof bracket.

A rigid elongated member 34 of suitable tubular material rests on the upper surface of the roof overhang 12 and is fixed to it by roof brackets 37, shown in detail in FIG. 2. The outer end of the member 34 has an interconnection 35 to the upright 32 at the location at which they intersect one another. A plurality of longitudinally spaced apertures in both members accommodates this intersection point. To provide a rigid angular connection between upright 32 and member 34, the interconnection at 35 is spaced inward from the outer end of member 34. A rigid brace 36 is secured to the upright 32 at a location beneath interconnection 35 and to member 34 at a location outward from interconnection 35. The resulting outer triangular configuration therefore provides rigid bracing between upright 32 and member 34.

Figure 10:
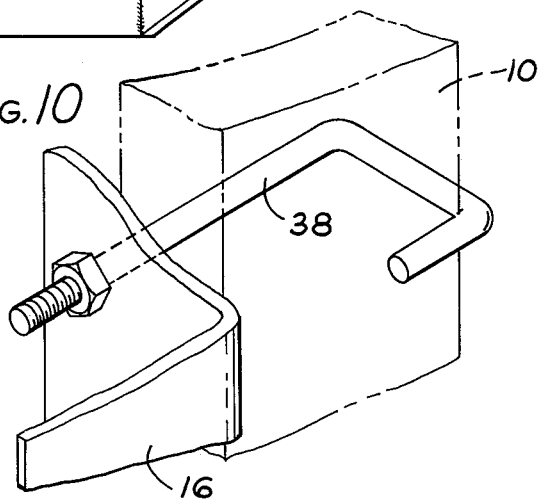
FIG. 10 is a fragmentary perspective view of a wall bracket and J-bolt assembly.

The wall bracket 16 can be fixed to the wall element 10 in any desired manner. FIGS. 1 and 5 illustrate the use of conventional nails, which can be readily installed and removed for transport of the scaffold structure. Another alternative is to use J-bolt 38, shown in detail in FIG. 10. The J-bolt 38 is partially wrapped about a wall stud to secure bracket 16 as desired.

Figure 8:
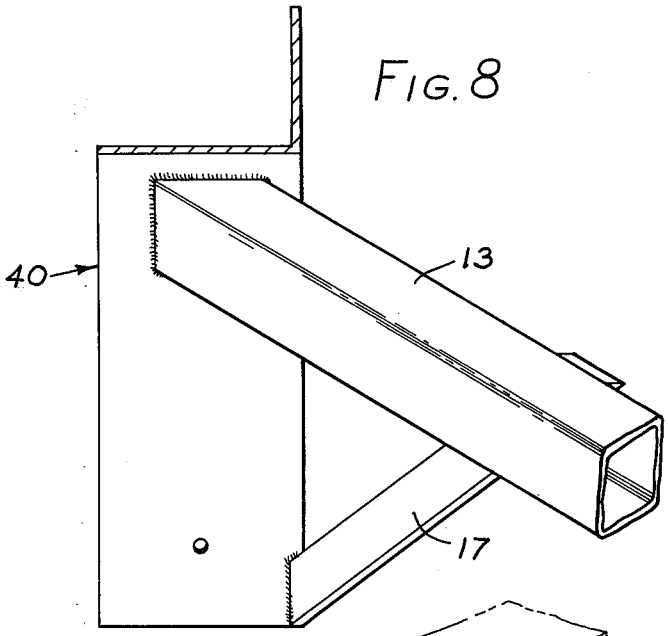
FIG. 8 is a fragmentary perspective view of a corner wall bracket.

A special wall bracket is required at an exterior wall corner. A typical bracket is shown in FIG. 8, including a vertical flange having perpendicular plates to wrap about the exterior building corner in the manner shown in FIG. 4. The corner wall bracket is generally indicated by the numeral 40.

Figure 4:
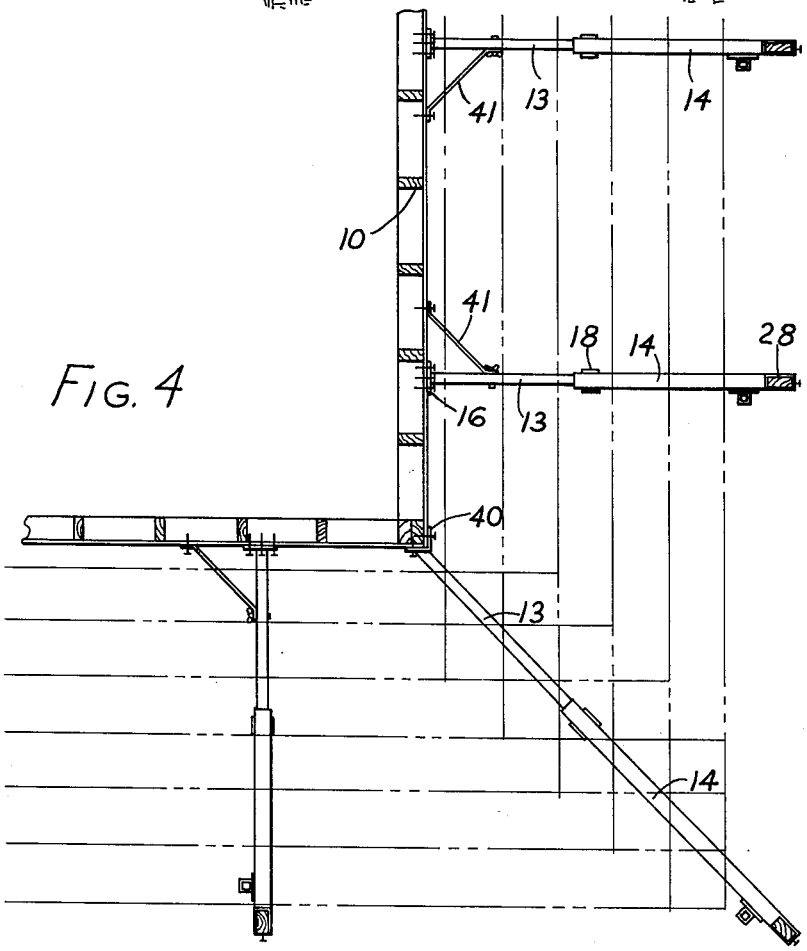
FIG. 4 is a plan view taken along line 4—4 in FIG. 1 at a reduced scale.

To provide transverse support to the members 13, 14, there are provided angular sway braces 41 which can be fixed to the intermediate portions of member 13 and which can be nailed or otherwise fastened to the supporting wall in the manner shown in FIG. 4.

The various elements illustrated in the drawings are adjustable to accommodate the size requirements of a particular job site. The braces and supports are either detachable or foldable with respect to the members 13, 14 which carry the removable platform 15. They can be readily detached from the wall and carried from one location to another and can be folded for efficient storage or transport purposes.

Having described my invention, I claim:

1. A scaffold structure for placement on an upright wall element, comprising:

first and second horizontal members adapted to support a horizontal work platform rested on the upper surfaces thereof;

said first horizontal member having opposed inner and outer ends;

means fixed to the inner end of the first horizontal member for securing it to an upright wall element at an above-ground elevation;

said second horizontal member having opposed inner and outer ends, the inner end of the second horizontal member being telescopically supported on the outer end of said first horizontal member coaxial adjustment relative thereto;

means for fixing said second horizontal member to said first horizontal member;

a bracket fixed to the inner end of said second horizontal member;

said bracket being open downwardly as well as vertically along a direction facing the first horizontal member;

and upright support means affixed to said bracket and extending downward perpendicular to said horizontal members or downward at an angle inclined to a fixed reference, whereby the first and second horizontal members are elevationally supported intermediate their combined lengths.

2. A scaffold structure as set out in claim 1 wherein said bracket is complementary in transverse width to the size of dimension lumber;

said upright support means comprising a board of such dimension lumber having a length suitable to extend between the bracket and a fixed reference.

3. A scaffold structure as set out in claim 2, further comprising:

a wall bracket partially encircling the lower end of the board and fixed thereto, and having a vertical flange integral therewith for attachment to an upright wall element.

4. A scaffold structure as set out in claim 1 wherein said second horizontal member has a vertically open end bracket fixed to the outer end thereof and having an interior cross-sectional configuration complementary to the thickness and width of dimension lumber; and a vertical board of such dimension lumber fixed within the end bracket.

5. A scaffold structure as set out in claim 1 wherein said second horizontal member has a vertically open end bracket fixed to the outer end thereof having an interior cross-sectional configuration complementary to the thickness and width of dimension lumber; and a vertical board of such dimension lumber fixed within the end bracket, said vertical board extending above the elevation of said horizontal members for support of a horizontal rail assembly.

6. A scaffold structure as set out in claim 1 wherein said second horizontal member has a vertically open end bracket fixed to the outer end thereof having an interior cross-sectional configuration complementary to the thickness and width of dimension lumber; and a vertical board of such dimension lumber fixed within the end bracket, said vertical board extending below the elevation of said horizontal members to ground level.

7. A scaffold structure as set out in claim 1 further comprising:

a longitudinally adjustable upright member having a lower end fixed to said second horizontal member adjacent the outer end thereof and extending upward therefrom;

a rigid elongated member having an outer end intersecting said upright member and fixed thereto; and means on said elongated member overlying said horizontal members for fixing it to a roof surface.

8. A scaffold structure as set out in claim 1 further comprising:

a longitudinally adjustable upright member having a lower end fixed to said second horizontal member adjacent the outer end thereof and extending upward therefrom;

a rigid elongated member having an outer end intersecting said upright member and fixed thereto;

and means on said elongated member overlying said horizontal members for fixing it to a roof surface, said last-named means comprising an interconnection between the upright member and said rigid elongated member at a location inwardly spaced from its outer end; and a rigid brace having one end fixed to said upright member below said interconnection and its remaining end fixed to the rigid elongated member outward from said interconnection.

* * * * *